US010369599B1

(12) United States Patent
Dunn

(10) Patent No.: US 10,369,599 B1
(45) **Date of Patent: *Aug. 6, 2019**

(54) TANK ASSEMBLY AND METHODS FOR NEUTRALIZATION AND DECONTAMINATION OF VALVES

(71) Applicant: J-S Machine & Valve, Inc., Nowata, OK (US)

(72) Inventor: Brian M. Dunn, Nowata, OK (US)

(73) Assignee: J-S MACHINE & VALVE, INC., Nowata, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/176,032

(22) Filed: Oct. 31, 2018

Related U.S. Application Data

(63) Continuation of application No. 15/471,448, filed on Mar. 28, 2017, now Pat. No. 10,118,203.

(51) Int. Cl.
*B08B 3/08* (2006.01)
*B08B 3/10* (2006.01)
*B08B 9/00* (2006.01)

(52) U.S. Cl.
CPC ..... *B08B 3/08* (2013.01); *B08B 3/102* (2013.01); *B08B 9/00* (2013.01)

(58) Field of Classification Search
None
See application file for complete search history.

(56) References Cited

U.S. PATENT DOCUMENTS

| | | | | |
|---|---|---|---|---|
| 4,025,363 | A * | 5/1977 | De Santis | B05B 14/00 134/102.2 |
| 4,363,674 | A * | 12/1982 | Fullenwider | A47L 13/34 110/171 |
| 5,322,078 | A * | 6/1994 | Tuttle | B08B 3/006 134/104.4 |
| 6,568,409 | B1 * | 5/2003 | Fleck | B08B 3/006 134/110 |
| 2009/0211616 | A1 * | 8/2009 | Tafoya | B08B 3/045 134/57 R |

* cited by examiner

*Primary Examiner* — Mikhail Kornakov
*Assistant Examiner* — Ryan L. Coleman
(74) *Attorney, Agent, or Firm* — Dennis D. Brown; Brown Patent Law, P.L.L.C.

(57) ABSTRACT

A tank apparatus and method for neutralizing or decontaminating valves which have been exposed to hydrofluoric acid or other contaminants wherein the valves are temporarily secured by valve holding structures provided on the interior walls of the tank so that the valves can be opened and at least partially disassembled while the valve holding structures retain the valves in the interior of the container below the fill level of a treatment fluid.

9 Claims, 5 Drawing Sheets

TANK ASSEMBLY AND METHODS FOR NEUTRALIZATION AND DECONTAMINATION OF VALVES

RELATED CASE

This application is a continuation U.S. patent application Ser. No. 15/471,448 filed Mar. 28, 2017.

FIELD OF THE INVENTION

The present invention relates to tanks, systems and methods for neutralizing or decontaminating valves which have been used in hydrofluoric acid alkylation units or have been used in other services which require that the valve be neutralized or decontaminated for maintenance, removal, or other purposes.

BACKGROUND OF THE INVENTION

Bulletins issued by the U.S. Occupational Safety and Health Administration (OSHA) have advised field personnel in petroleum refineries and in chemical plants of the potential safety and health risks posed by hydrofluoric acid (HF) used in HF alkylation units and in other services. These bulletins have also presented control measures to reduce workers' exposure.

In recent years, the petroleum refining industry has placed an increasing emphasis on safety when using HF in petroleum refineries. Refineries use the acid in a process called "alkylation," for producing high-octane gasoline. Hydrofluoric acid is hazardous and corrosive and, if accidently released, can form a vapor cloud. If the vapor cloud is sufficiently concentrated, it can be toxic. OSHA also notes that there have been a number of accidental releases of this acid from alkylation units at major petroleum refineries in the United States.

Pure hydrogen fluoride is a clear, colorless, corrosive liquid that has roughly the same weight as water (comparing equal volumes). It boils at 67° F. and can form a vapor cloud if released to the atmosphere. It has a sharp, penetrating odor that humans can detect at very low concentrations (0.04-0.13 ppm[2]) in the air.

To protect against adverse effects from exposure to hydrofluoric acid in the workplace, OSHA has established a permissible exposure limit (PEL) of 3 ppm averaged over an eight-hour work shift. The National Institute for Occupational Safety and Health has established an "Immediately Dangerous to Life or Health" (IDLH) concentration level for HF of 30 ppm[3].

Any contact with HF liquid or vapor cats produce serious, painful chemical burns, sometimes with delayed onset and hypocalcemia. The vapor can be extremely irritating to the eyes, skin and respiratory tract. Short-term exposure at high concentrations can cause serious health effects or death due to extensive respiratory damage.

As with other refinery processes, the primary exposure control method used in HF alkylation units is to contain of all process substances within the unit equipment (i.e., vessels, piping, and pumps). The greatest potential for exposure occurs: during process stream sampling; when unloading the HF from trucks; as a result of process leaks (fugitive emissions); as a result of equipment failures (e.g., pump seals); and during equipment maintenance.

Commonly, vats containing soda ash solutions have been used for neutralizing any contaminated equipment which must be removed from the HF alkylation unit for maintenance, replacement or disposal. However, the vats currently used in the art are not well suited for effectively and safely neutralizing valves which have been used in HF service or have been used for delivering other toxic or harmful fluids.

Consequently, a need exists for an improved tank assembly, system, and method for neutralizing valves which have been used in HF service or in other toxic or harmful services. Moreover, a need particularly exists for an improved neutralization or decontamination tank assembly, system, and method wherein a contaminated valve can be fully submerged in the treatment fluid and held securely in place such that, while the valve is held below the liquid level, the field personnel can easily open the valve, remove any packing therein, and loosen, cycle, or otherwise expose all of the components of the valve for thorough neutralization and decontamination, while at the same time helping to protect the field personnel from exposure.

SUMMARY OF THE INVENTION

The present invention satisfies the needs and alleviates the problems discussed above.

In one aspect, there is provided a tank apparatus for treating a valve comprising: (a) a container for holding a treatment fluid, the container having an interior, an interior floor, and one or more interior side walls and (b) one or more V-shaped holding brackets for holding one or more flanged valves. The one or more V-shaped holding brackets are attached in the interior of the container to one or more of the interior side walls and each of the V-shaped holding brackets has an open upper end.

In another aspect, there is provided a method which uses the tank apparatus just described to treat a flanged valve (i.e., a valve having flange connections). The method comprises the steps of: (a) filling the container with a treatment fluid to a fill level; (b) placing a flange of the flanged valve in one of the one or more V-shaped holding brackets such that the flanged valve is retained in the interior of the container by the one V-shaped holding bracket and is entirely submerged in the treatment fluid below the fill level; and (c) opening and/or at least partially disassembling the flanged valve while the one V-shaped holding bracket retains the flanged valve in the interior of the container below the fill level of the treatment fluid.

In another aspect, there is provided a tank apparatus for treating a valve comprising: (a) a container for holding a treatment fluid, the container having an interior, an interior floor, and one or more interior side walls and (b) one or more threaded valve holding structures attached in the interior of the container to one or more of the interior side walls, each of the threaded valve holding structures having threads on an exterior portion thereof.

In another aspect, there is provided a method which uses the tank apparatus just described to treat a threaded valve (i.e., a valve having threaded connections). The method comprises the steps of: (a) filling the container with a treatment fluid to a fill level; (b) threadedly connecting the threaded valve to one of the one or more threaded valve holding structures such that the threaded valve is retained in the interior of the container by the one threaded valve holding structure and is entirely submerged in the treatment fluid below the fill level; and (c) opening and/or at least partially disassembling the threaded valve while the one threaded valve holding structure retains the threaded valve in the interior of the container below the fill level of the treatment fluid.

Further aspects, features, and advantages of the present invention will be apparent to those of ordinary skill in the art upon examining the accompanying drawings and upon reading the following Detailed Description of the Preferred Embodiments.

DETAILED DESCRIPTION OF THE PREFERRED EMBODIMENTS

Figure 1:
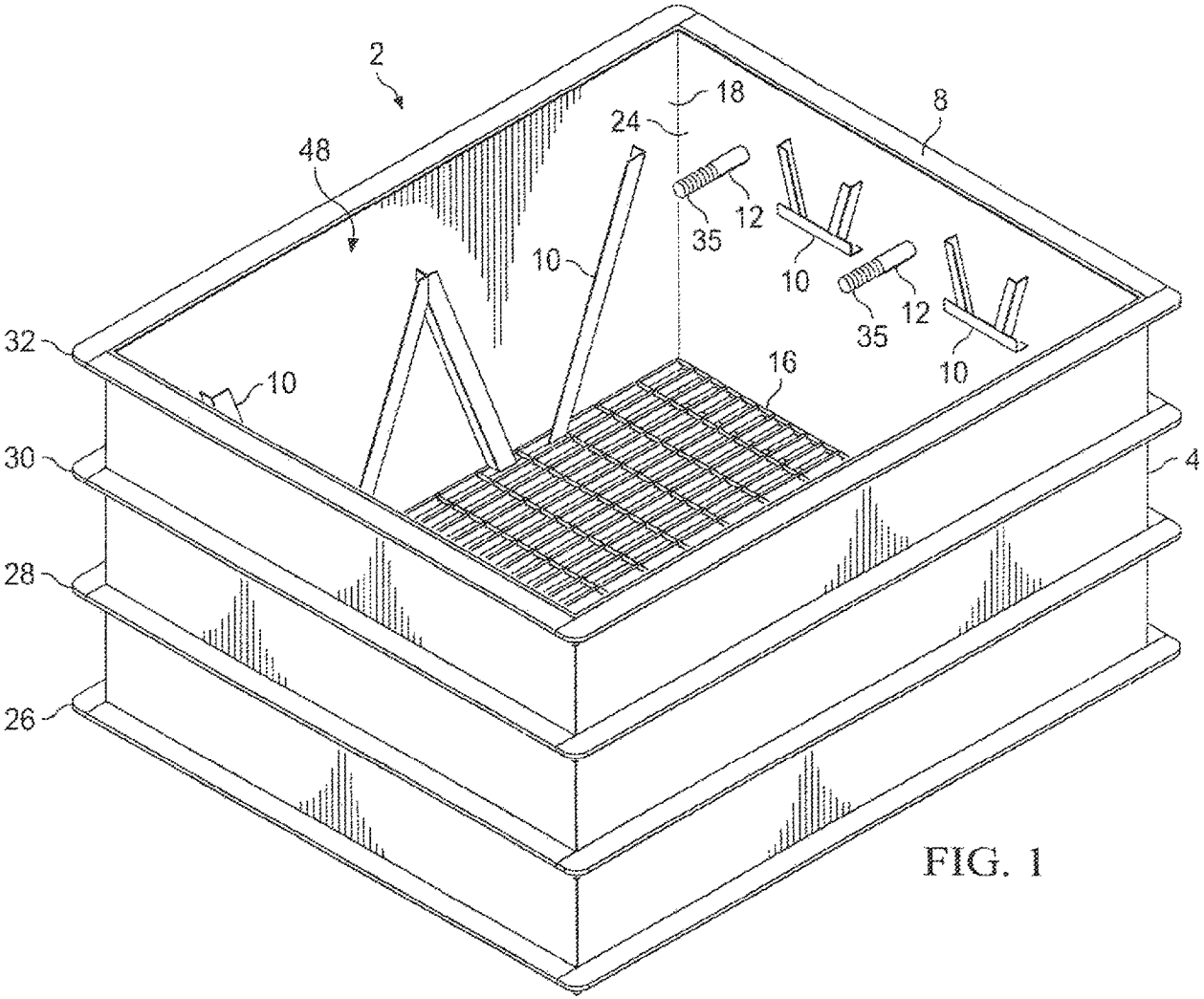
FIG. 1 is a perspective view of an embodiment 2 of the tank apparatus provided by the present invention.
Figure 2:
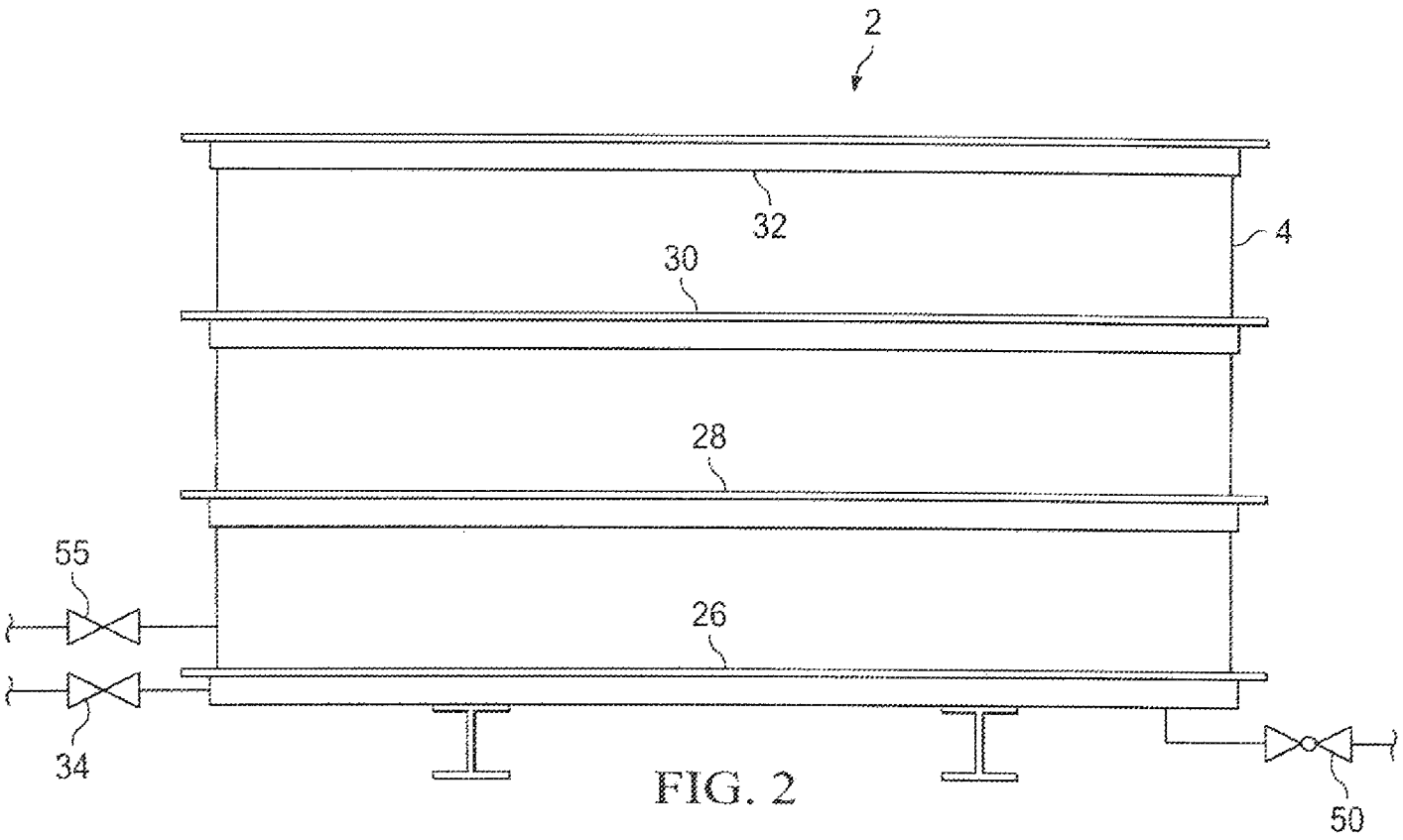
FIG. 2 is an elevational side view of the inventive tank apparatus 2.
Figure 3:
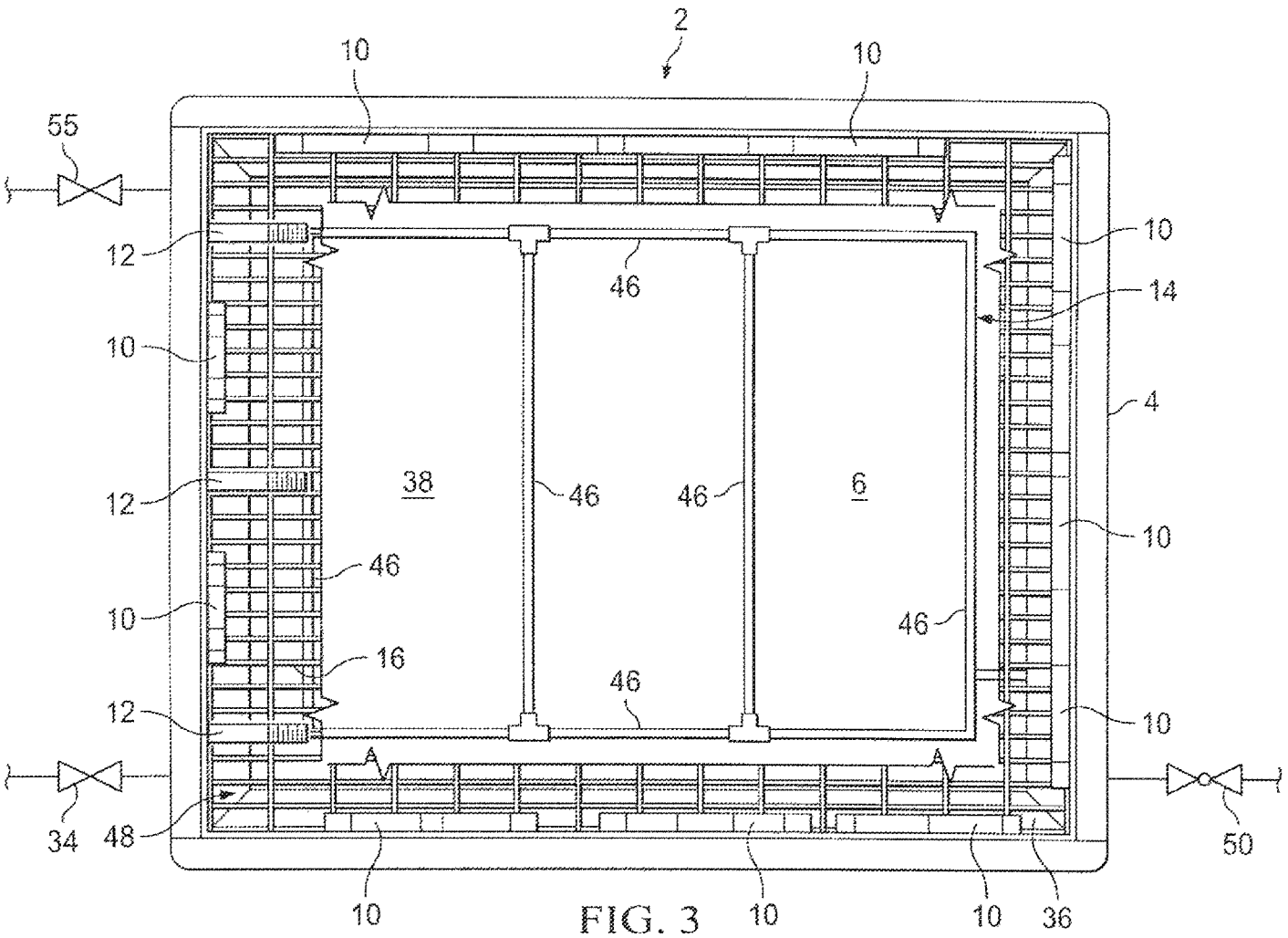
FIG. 3 is a plan view of the inventive tank apparatus 2 showing only a portion of an interior grate 16 used in the apparatus 2.
Figure 4:
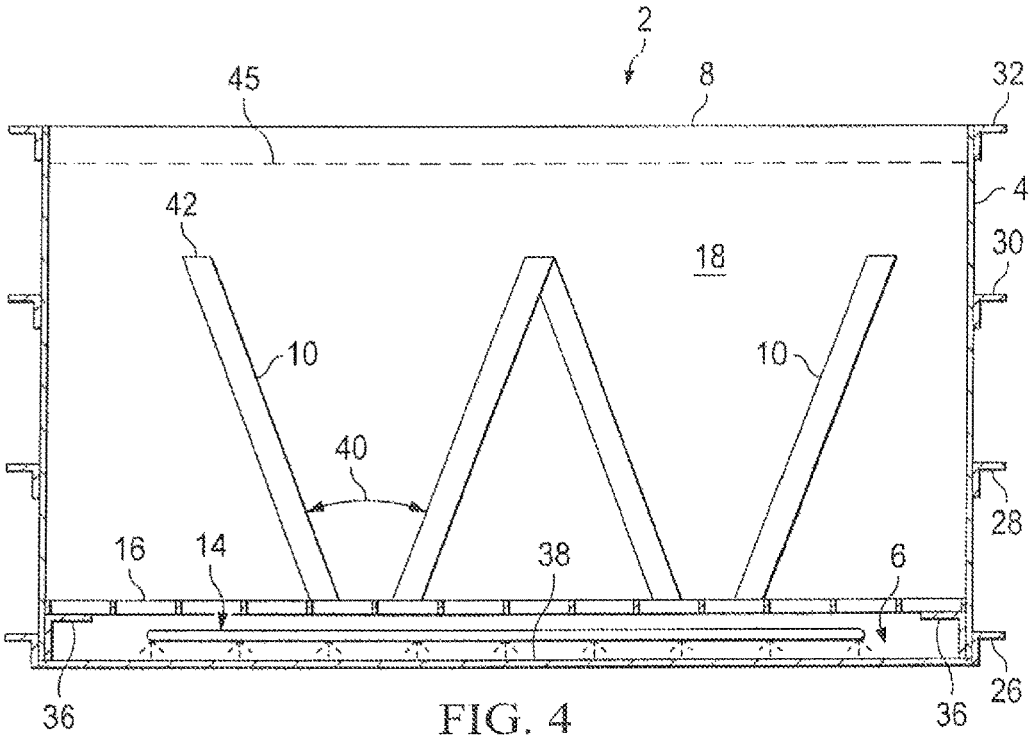
FIG. 4 is a cutaway elevational side view of the inventive tank apparatus 4 showing an interior side wall 18 thereof.
Figure 5:
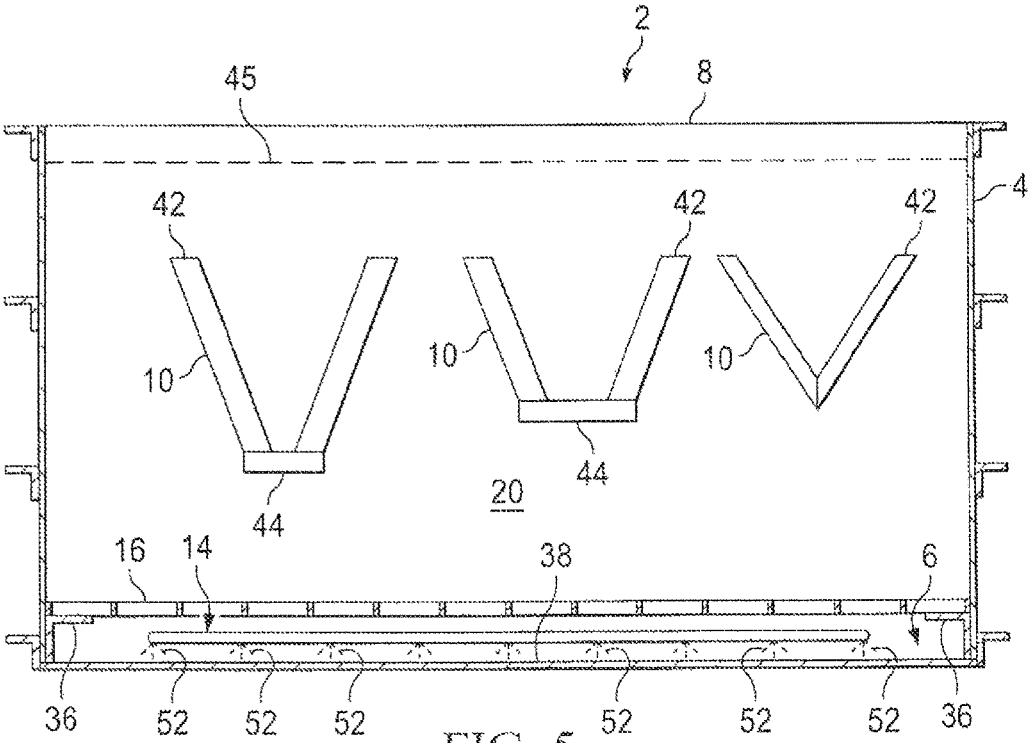
FIG. 5 is a cutaway elevational side view of the inventive tank apparatus 4 showing an interior side wall 20 thereof.
Figure 6:
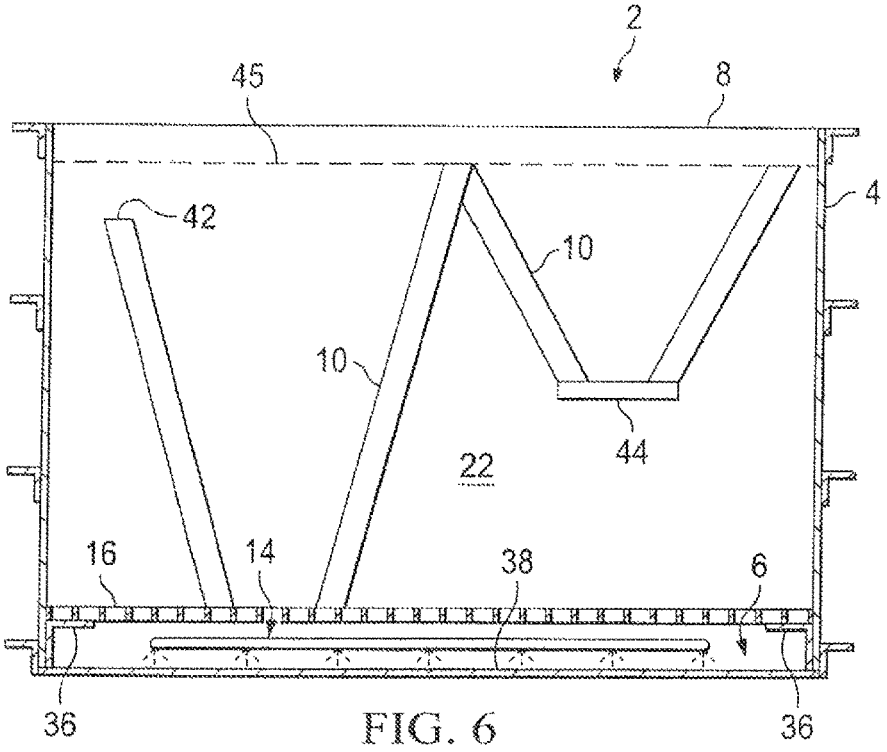
FIG. 6 is a cutaway elevational end view of the inventive tank apparatus 4 showing an interior end wall 22 thereof.
Figure 7:
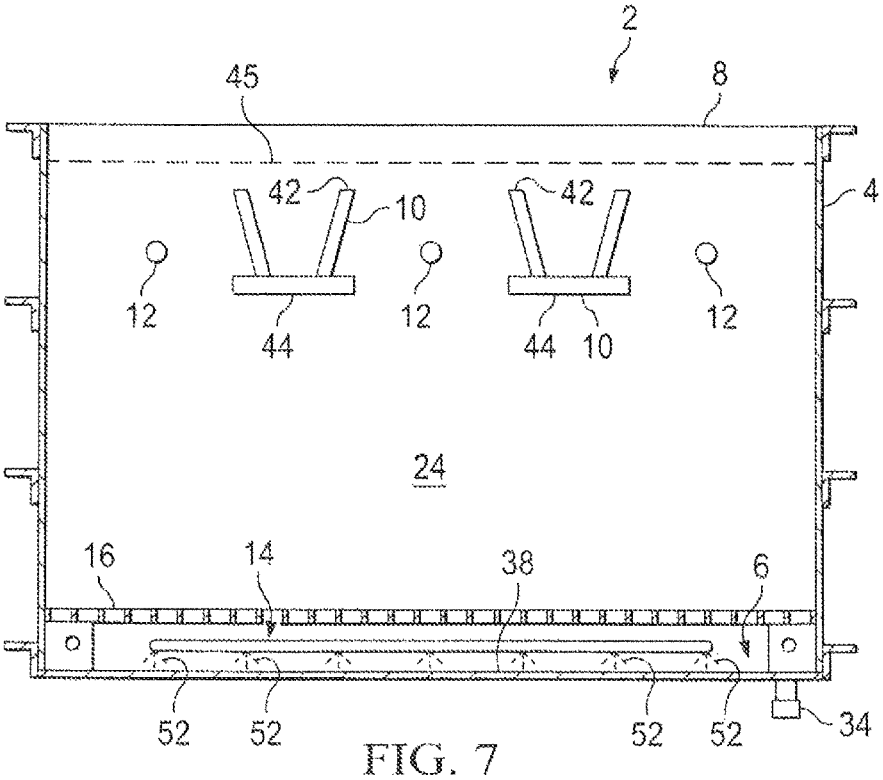
FIG. 7 is a cutaway elevational end view of the inventive tank apparatus 4 showing an interior end wall 24 thereof.

An embodiment 2 of the tank assembly provided by the present invention for neutralizing or decontaminating process valves is illustrated in the FIGS. 1-7. The tank assembly 2 preferably comprises: a container 4 having a bottom 6 and an open top end 8; a plurality of V-shaped and/or truncated V-shaped flanged valve holding brackets 10 attached to the interior side wall or walls of the container 4 for holding valves which have flange connections; a plurality of threaded pipe segments, threaded rods or other threaded valve holders 12 which are attached to and project from the interior side wall or walls of the container 4 for threadedly holding smaller threaded valves; a circulation fluid injection structure 14, preferably comprising an array of pipe, tube or other conduit segments 46, provided in the bottom of the container 4 for circulating the neutralizing or decontaminating fluid; and an open grate 16 positioned in the bottom of the container 4 above the circulation fluid injection structure 14.

Although other shapes can also be used, the container 4 is preferably a square or rectangular tank having upwardly extending interior side walls 18, 20, 22, and 24. An upwardly extending series of horizontal exterior brace structures 26, 28, 30, and 32, preferably formed of welded angle iron segments, are welded or otherwise secured around the exterior of the tank 4. The exterior brace structures 26, 28, 30, and 32 strengthen the container 4, not only for containing the neutralizing or decontaminating fluid place in the container 4, but also for supporting the weight of the valves which are retained on the interior side walls 18, 20, 22, and 24 of the tank 4 by the V-shaped brackets 10 and/or the threaded holders 12.

The container 4 preferably also comprises: a bottom drain 34 which is provided in the bottom 6 of the container 4 and is preferably located at an end or a corner of the container 4; an interior floor 38 provided in the bottom 6 of the container 4 which slopes toward the drain 34; and a horizontal interior ledge 36 which projects inwardly into the interior 48 of the container 4 from two, three, or all four of the interior side walls 18, 20, 22, and 24 for supporting the grate 16 in the bottom of the container 4 above the circulation fluid injection structure 14. The ledge 36 is preferably formed of angle iron segments which are welded or otherwise secured near the lower ends of two, three, or all four of the interior side walls 18, 20, 22, and 24 for supporting the grate 16 in a horizontal position which is preferably about 6 inches above the highest point of the sloped interior floor 38 in the bottom of the container 4.

The primary purpose of the open grating 16 in the bottom of the container 4 is to protect the fluid circulation array or other circulation fluid injection structure 14, positioned beneath the grating 16, from being damaged in the event that a valve or other heavy object is accidently dropped into the container 4. At the same time, the open nature of the grating 16 does not interfere with the desired circulation of the treatment fluid in the container 4, which is created by injecting air, steam or other motive fluid into the container 4 via the circulation fluid injection structure 14. The grating 16 will preferably be a 1 inch open floor grate.

The V-shaped brackets 10 provided in the container 4 are preferably formed of angle iron segments which are welded to the interior side walls 18, 20, 22, and 24 such that the V angle 40 of each of the brackets is in the range of from about 50° to about 70°, more preferably from about 55° to about 65°, and is most preferably about 60°. These angles are effective for securely holding the flanged valves such that the valves can be opened, disassembled and/or otherwise manipulated in any manner needed without the need for a vice.

The upper ends 42 of the V-shaped brackets will preferably be located at an elevation in the interior 48 of the container 4 which is at least 1.5 inches, more preferably from about 3 to about 8.5 inches, below the open top end 8 of the container 4.

However, the depth of the V-shaped brackets 10 can be varied as needed to allow flanged valves of different sizes to be held in the container 4 beneath the surface of the neutralizing or decontaminating fluid such that each valve will be fully submerged in the treatment fluid during disassembly. Larger valves will be placed in the brackets 10 of greater depth and smaller valves will be placed in the brackets 10 of lesser depth. Preferably, brackets 10 of different depths will be provided in the container 4 for holding flanged plug valves or other flanged valves ranging in size of from about ½ inch to about 12 inches. Examples of other types of flanged valves which can be treated in the inventive tank assembly 2 include, but are not limited to, gate valves, globe valves, and check valves.

As noted above, the V-shaped brackets 10 of greater depth, as well as some or all of the brackets 10 of smaller size if desired, will preferably have reinforced, truncated, horizontal lower ends 44. The truncated lower ends 44, will preferably be formed of reinforcing angle iron segments which are welded to the bottoms of the V-shaped brackets 10 and to the interior side walls 18, 20, 22, or 24 of the container 4. These reinforcing structures 44 provide reinforcement for resisting the significant side torque needed to actuate the valves. Alternatively, the lower ends of the V-shaped brackets can be reinforced using gussets or other reinforcing structures.

As further noted above, a plurality of externally threaded pipe segments, externally threaded rods or other valve holders 12 having external threads 35 formed thereon are preferably also attached to one or more of the interior side walls 18, 20, 22, and 24 of the container 4 for retaining and neutralizing or decontaminating smaller threaded valves (i.e., valves having threaded connections). By way of example, but not by way of limitation, threaded pipe segments, rods or other threaded valve holding structures 12 of different diameters will preferably be provided in the container for holding threaded plug valves or other types of threaded valves having common sizes of ½ inch, ¾ inch, and/or 1 inch. The threaded holders 12 will preferably be positioned a sufficient distance below the open top end 8 of the container 4 so that the threaded valves will be positioned beneath the fill level 45 of the treatment fluid and will remain fully submerged during disassembly. The threaded holders 12 will preferably be located at least 1.5 inches, more preferably from about 3 to about 6 inches, below the open top end 8 of the container 4.

The tank assembly 2 also comprises a filling line 55 for filling the container 4 with the neutralizing or decontaminating solution and for supplying fresh fluid to adjust or maintain the pH, concentration, or volume of the solution as necessary. The container 4 can alternatively be filled using a hose.

The circulation fluid injection structure 14 in the bottom of the container 4 preferably comprises an array of interconnected pipe segments, tubes or other conduits 46 which cause the array 14 to preferably extend over at least most of the horizontal cross-section of the interior 48 of the container 4. The circulation array 14 also comprises an inlet line 50 which extends through the bottom or sidewall of the container 4 for (a) connecting an air line to the injection array 14 for injecting air into the bottom of the container 4 for circulating the neutralizing or decontaminating solution or (b) connecting a steam line to the injection array 14 for injecting steam into the container 4 to both circulate and heat the neutralizing or decontaminating solution if necessary.

Each segment 46 of the circulation array 14 in the interior 48 of the container 4 preferably has a series of ports, nozzles or other ejection openings 52 which are provided in the bottom thereof (i.e., which face the interior floor 38 of the container 4) for ejecting the air, steam or other circulation fluid toward the floor 38. The ejection openings 52 can be of any shape, size and spacing which is effective for circulating the fluid in the container 4. The openings 52 will preferably be ejection ports which are about 3/32 inches in diameter and are spaced about 3 inches apart. Facing the ejection openings 52 downward assists in preventing the soda ash or other neutralizing or decontaminating agent in the treatment fluid from settling in the bottom of the container 4.

In addition to soda ash (i.e., sodium carbonate), examples of other neutralizing agents which can be used in the inventive tank apparatus 2 for neutralizing valves which have been used in HF acid service include, but are not limited to, caustic soda (sodium hydroxide), caustic potash (potassium hydroxide), sodium bicarbonate, limestone (calcium carbonate), quicklime (calcium oxide), and hydrated lime (calcium hydroxide).

In preparing the neutralizing solution, a sufficient amount of the neutralizing agent (e.g., soda ash, sodium hydroxide, or other) will preferably be mixed with water to provide a pH in the range of from about 6 to about 10. The pH of the neutralizing solution will more preferably be about 7. The container 4 will preferably be filled with the neutralizing solution to a fill level 45 sufficient to entirely cover the valve or valves which is/are being treated. To entirely cover the valve or valves being treated, the container 4 will typically be filled to a fill level 45 which is from about 1 to about 2 inches below the open top end 8 of the container 4. Once the container 4 is filled, the field personnel will preferably begin the delivery of air or steam through the circulation fluid injection structure 14 in the bottom of the container 4 to purge and circulate the neutralizing solution. The pH of the neutralizing solution will also preferably be monitored or checked either continuously, periodically or at least after each valve is neutralized. In addition, supplemental neutralizing solution will preferably be added as needed to maintain the desired pH, and to also maintain the desired fluid level in the container 4.

A recommended procedure for neutralizing or decontaminating a plug valve in the inventive tank assembly 2 preferably comprises the steps of: (1) dipping the valve in the treatment solution; (2) securing the valve in an appropriate V bracket 10 or on an appropriate threaded holder 12 so that the top of the valve is close to the liquid fill level (i.e., the fluid surface) 45 in the container 4 but is fully submerged; (3) if the plug is closed, opening the valve in the treatment solution; (4) loosening the adjuster and bonnet bolts of the valve; (5) moving the adjuster and top cap of the valve to ensure that these parts are loose and free floating; (6) once the bolting of the valve has been sufficiently loosened, cycling the valve plug to cause the plug to rise and ensure that the treatment fluid comes into contact with any acid or other contaminant that may be trapped under the plug; (7) removing the valve from the container 4 with the valve in the open position; and (8) placing an identification tag on the valve indicating its prior service and showing that it has been properly treated.

A recommended procedure for neutralizing or decontaminating a gate valve in the inventive tank assembly 2 preferably comprises the steps of: (1) dipping the valve in the treatment solution; (2) securing the valve in an appropriate V bracket 10 or on an appropriate threaded holder 12 so that the top of the valve is close to the liquid fill level (i.e., the fluid surface) 45 in the container 4 but is fully submerged; (3) if the valve is closed, opening the valve in the treatment solution; (4) loosening the bonnet bolts and the packing gland bolts of the valve; (5) moving the bonnet and packing gland to ensure separation of these parts so that they are loose and free floating; (6) once the bolting is loosened and the bonnet/body connection is free, removing the gland pusher from the valve packing chamber; (7) removing the packing from the packing chamber and discarding the packing; (8) placing any parts which have been removed from the valve in the treatment solution to ensure that all parts are exposed to the treatment solution; (9) removing the neutralized or decontaminated valve from the container; and (10) placing an identification tag on the valve indicating its prior service and showing that it has been properly treated.

A recommended procedure for neutralizing or decontaminating a globe valve in the inventive tank assembly 2 preferably comprises the steps of: (1) dipping the valve in the treatment solution; (2) securing the valve in an appropriate V bracket 10 or on an appropriate threaded holder 12 so that the top of the valve is close to the liquid fill level (i.e., the fluid surface) 45 in the container 4 but is fully submerged; (3) if the valve is closed, opening the valve in the treatment solution; (4) loosening the bonnet bolts and the packing gland bolts of the valve; (5) moving the bonnet and packing gland to ensure separation of these parts so that they are loose and free floating; (6) once the bolting is loosened and the bonnet/body connection is free, removing the gland pusher from the valve packing chamber; (7) removing the packing from the packing chamber and discarding the packing; (8) placing any parts which have been removed from the valve in the treatment solution to ensure that all parts are exposed to the treatment solution; (9) removing the neutralized or decontaminated valve from the container; and (10) placing an identification tag on the valve indicating its prior service and showing that it has been properly treated.

A recommended procedure for neutralizing or decontaminating a check valve in the inventive tank assembly 2 preferably comprises the steps of: (1) dipping the valve in the treatment solution; (2) securing the valve in a appropriate V bracket 10 or on an appropriate threaded holder 12 so that the top of the valve is close to the liquid fill level (i.e., the fluid surface) 45 in the container 4 but is fully submerged; (3) loosening the top cap bolts of the valve; (4) once the top cap bolting is loose, prying the top cap free from the valve body; (5) inspecting the valve for any pipe plugs that are not welded on the valve; (6) if there are any pipe plugs on the valve that are not welded, removing the non-welded plugs and dipping them into the treatment solution; (7) placing any parts which have been removed from the valve in the treatment solution to ensure that all parts are exposed to the treatment solution; (8) removing the valve from the container 4; (9) reinstalling any pipe plugs that were removed so that the plugs are finger tight; and (10) placing an identification tag on the valve indicating its prior service and showing that it has been properly treated.

Thus, the present invention is well adapted to carry out the objects and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within this invention as defined by the claims.

What is claimed is:

1. A tank apparatus for treating a valve comprising:

a container for holding a treatment fluid, the container having a plurality of side walls which surround an interior of the container, and the container also having an interior floor and an open upper end;

one or more truncated V-shaped holding brackets for holding one or more flanged valves, each of the one or more truncated V-shaped holding brackets being attached in fixed position on an interior side wall surface of one of the side walls such that each of the one or more truncated V-shaped holding brackets is located in the interior of the container;

a circulation fluid injection structure positioned in bottom of the interior of the container, wherein the circulation fluid injection structure comprises an array of conduit segments configured to inject circulating fluid into the interior of the container in order to circulate the treatment fluid;

a grating structure positioned in the interior of the container, wherein the grating structure is positioned at an elevation that is above the circulation fluid injection structure, and wherein the grating structure is not positioned at an elevation where the grating structure would block the one or more truncated V-shaped holding brackets from receiving the one or more valves;

each of the one or more truncated V-shaped holding brackets having an open upper end which is located below the open upper end of the container; and each or the one or more truncated V-shaped holding brackets further comprising (i) a horizontal lower segment which is attached to the interior side wall surface and which adds reinforcing strength to the truncated V-shaped holding bracket which resists side torque forces imparted when opening, disassembling, or manipulating a flanged valve held in the truncated V-shaped holding bracket and (ii) a pair of opposing side bracket segments attached to the interior side wall surface which diverge outwardly as they extend upwardly from the horizontal lower segment at a V angle in a range of from about 50° to about 70°, which is an angle effective to hold a flanged valve in fixed position in the truncated V-shaped holding bracket.

2. The tank apparatus of claim 1 wherein the V angle is from about 55° to about 65°.

3. The tank apparatus of claim 1 wherein the container is a substantially square or substantially rectangular container having four of said side walls and wherein at least one of the one or more truncated V-shaped holding brackets is attached on the interior side wall surface of a first one of the side walls and at least one other of the one or more truncated V-shaped holding brackets is attached on the interior side wall surface of a second one of the side walls.

4. The tank apparatus of claim 1 further comprising an inject line which extends through a bottom or one of the side walls of the container and is connected to the array of segments, wherein the inject line allows circulating fluid to be supplied to the array of conduit segments.

5. The tank apparatus of claim 4 wherein the array of conduit segments has a plurality of ports, nozzles, or other fluid ejection openings which face the interior floor of the container.

6. The tank apparatus of claim 4 wherein the grating structure is a one-piece, horizontal structure.

7. The tank apparatus of claim 1 further comprising (i) a first of the one or more truncated V-shaped holding brackets having a depth and (ii) a second of the one or more truncated V-shaped holding brackets having a depth which is greater than the depth of the first of the one or more truncated V-shaped holding brackets.

8. The tank apparatus of claim 1 wherein the open upper end of each of the one or more truncated V-shaped holding brackets is located at least 1.5 inches below the open upper end of the container.

9. The tank apparatus of claim 1 further comprising at least two vertically spaced, exterior horizontal brace structures which are welded to and extend entirely around an exterior of the container.

* * * * *